US005226983A

United States Patent [19]

Skinner et al.

[11] Patent Number: 5,226,983

[45] Date of Patent: Jul. 13, 1993

[54] HIGH STRENGTH, DUCTILE, LOW DENSITY ALUMINUM ALLOYS AND PROCESS FOR MAKING SAME

[75] Inventors: David J. Skinner, Long Valley; Santosh K. Das, Randolph; Richard L. Bye, Morristown, all of N.J.

[73] Assignee: Allied-Signal Inc., Morris Township, Morris County, N.J.

[21] Appl. No.: 786,683

[22] Filed: Nov. 1, 1991

Related U.S. Application Data

[63] Continuation-in-part of Ser. No. 672,991, Mar. 21, 1991, abandoned, which is a continuation-in-part of Ser. No. 548,444, Jul. 5, 1990, abandoned, which is a continuation of Ser. No. 443,810, Nov. 29, 1989, abandoned, which is a continuation of Ser. No. 112,029, Oct. 23, 1987, abandoned, which is a continuation of Ser. No. 752,433, Jul. 8, 1985, abandoned.

[51] Int. Cl.[5] ..... C22F 1/04

[52] U.S. Cl. ..... 148/549; 148/698; 148/699; 148/700; 148/702; 148/415; 148/437

[58] Field of Search ..... 148/2, 3, 11.5 A, 12.7 A, 148/159, 415, 538, 549, 698, 699, 700, 702, 437; 164/475

[56] References Cited

U.S. PATENT DOCUMENTS

| | | | |
|---|---|---|---|
| 4,747,884 | 5/1988 | Gayle et al. | 148/415 |
| 5,076,859 | 12/1991 | Rioja et al. | 148/698 |
| 5,091,019 | 2/1992 | LaSalle | 148/11.5 A |

OTHER PUBLICATIONS

Gregson et al., "Microstructural Control of Toughness in Aluminum-Lithium Alloys", Acta Metallurgica, [33], pp. 527-537 (1985).

B. van der Brandt et al., "Rapid Solidification Processing of Al-Cu-Li-Mg Alloys", Aluminum-Lithium Alloy II, Met. Soc. of AIME, pp. 433-446 (1984).

F. W. Gayle et al., "Composite Precipitates in an Al-Li-Zr Alloy", Scripts Metallurgica, [18], pp. 473-478, (1984).

P. L. Makin et al., "On the Ageing of an aluminum-Lithium-zirconium alloy", J. Mat. Sci., [19], pp. 3835-3843 (1984).

P. J. Gregson et al., "precipitation in Al-Li-Mg-Cu-Zr alloys", J. Mat. Sci. Lett., [3], pp. 829-834 (1984).

P. L. Makin et al., "The nature of the cores composite particles formed in a Li-containing aluminum alloy", Phil. Mag. Lett., [51], pp. L41-L47 (1985).

*Primary Examiner*—R. Dean
*Assistant Examiner*—Robert R. Kohler
*Attorney, Agent, or Firm*—Ernest D. Buff; Gerhard H. Fuchs

[57] ABSTRACT

The present invention provides a process for making high strength, high ductility, low density rapidly solidified aluminum-base alloys, consisting essentially of the formula $Al_{bal}Zr_aLi_bX_c$, wherein X is at least one element selected from the group consisting of Cu, Mg, Si, Sc, Ti, U, Hf, Be, Cr, V, Mn, Fe, Co and Ni, "a" ranges from about 0.2-0.6 wt %, "b" ranges from about 2.5-5 wt %, "c" ranges from about 0-5 wt % and the balance is aluminum. The alloy is given multiple aging treatments after being solutionized. The microstructure of the alloy is characterized by the precipitation of a composite phase in the aluminum matrix thereof.

9 Claims, 6 Drawing Sheets

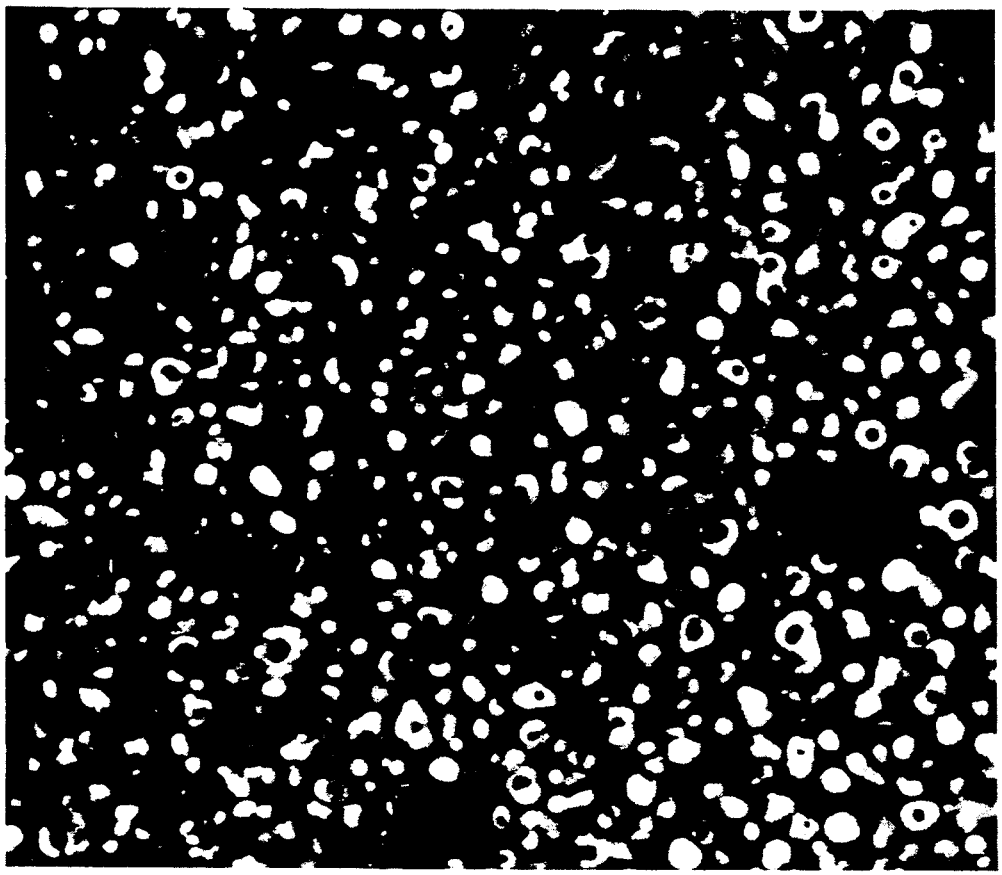
Fig. 1 0.1 μm

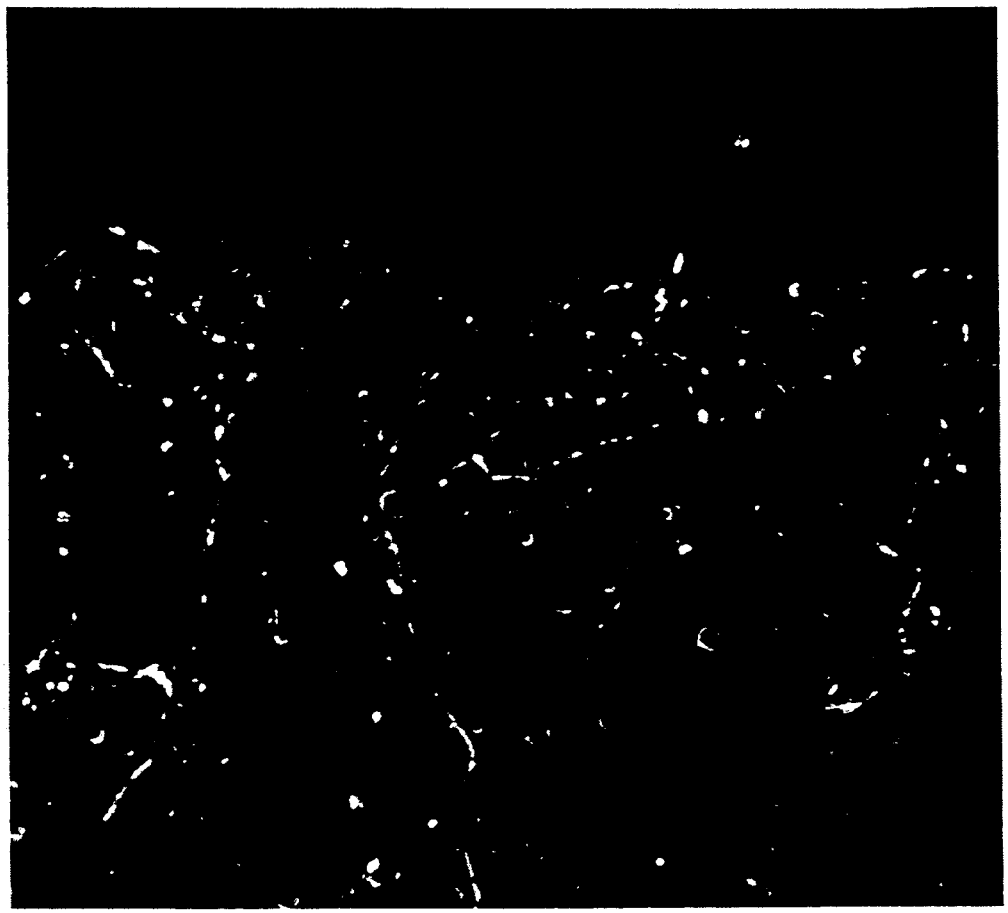
Fig.2 0.1 μm

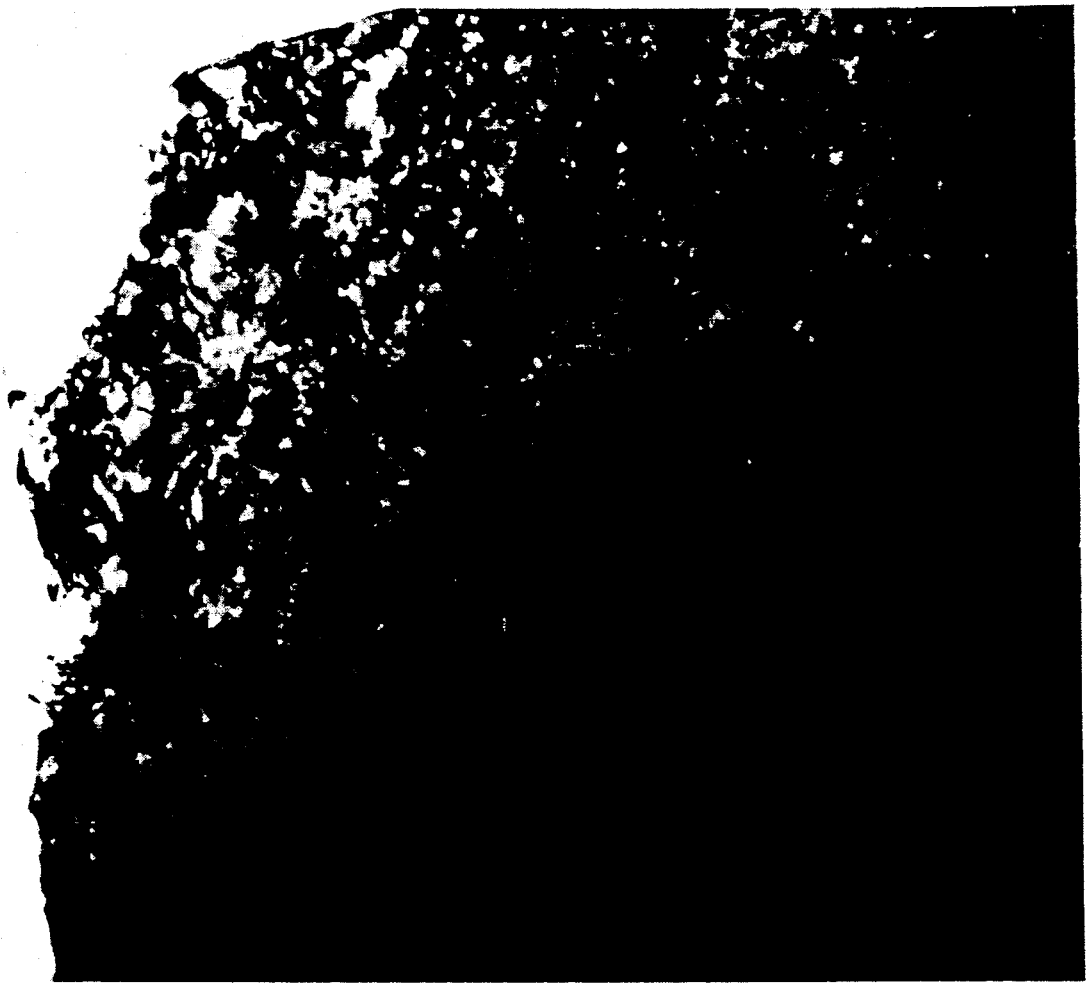
Fig. 3(a) 0.2μm

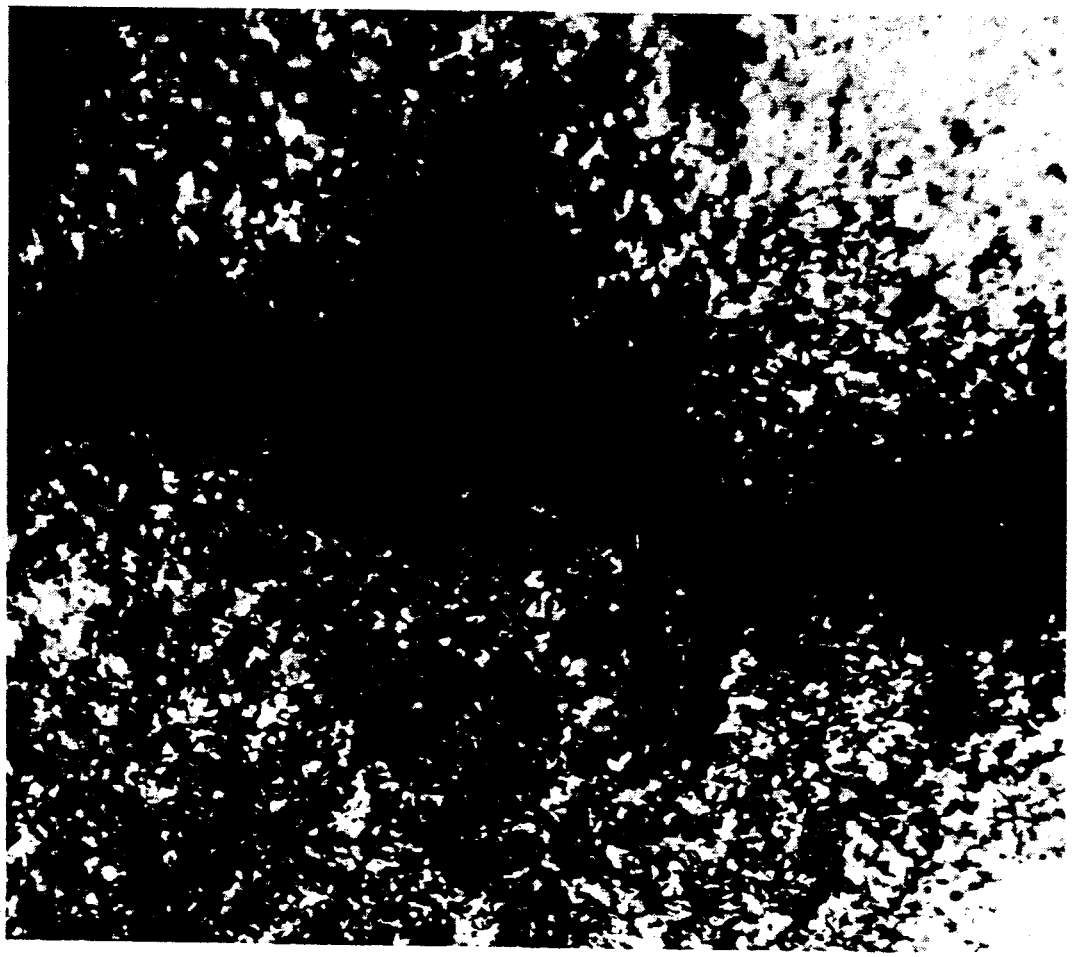
Fig.3(b) 0.2μm 0.2 μm

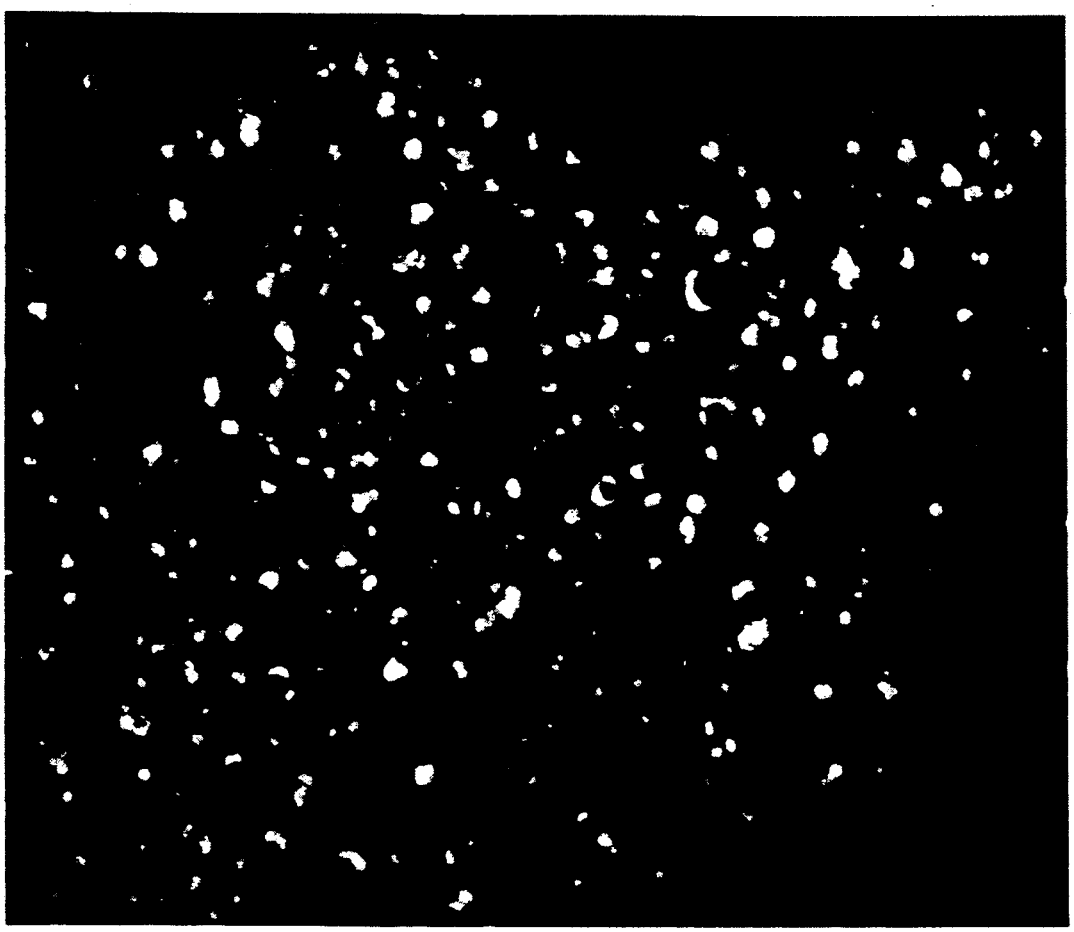
Fig.5 0.1 μm

HIGH STRENGTH, DUCTILE, LOW DENSITY ALUMINUM ALLOYS AND PROCESS FOR MAKING SAME

CROSS-REFERENCE TO RELATED APPLICATIONS

This application is a continuation-in-part of copending application Ser. No. 672,991, filed Mar. 21, 1991 which, in turn, is a continuation-in-part of application Ser. No. 548,444, filed Jul. 5, 1990 which, in turn, is a continuation of application Ser. No. 443,810, filed Nov. 29, 1989 which, in turn, is a continuation of application Ser. No. 112,029, filed Oct. 23, 1987 which, in turn, is a continuation of application Ser. No. 752,433, filed Jul. 8, 1985, all prior applications now abandoned.

DESCRIPTION

1. Field of the Invention

The invention relates to a process for making high strength, high ductility, low density rapidly solidified aluminum-based alloys and, in particular, to alloys that are characterized by a homogeneous distribution of composite precipitates in the aluminum matrix hereof. The microstructure is developed by a heat treatment method consisting of initial solutionizing treatment followed by multiple aging treatments.

2. Background of the Invention

There is a growing need for structural alloys with improved specific strength to achieve substantial weight savings in aerospace applications. Aluminum-lithium alloys offer the potential of meeting the weight savings due to the pronounced effects of lithium on the mechanical and physical properties of aluminum alloys. The addition of one weight percent lithium (3.5 atom percent) decreases the density by 3% and increases the elastic modulus by 6%, hence giving substantial increase in the specific modulus (E/P). Moreover, heat treatment of alloys results in the precipitation of a coherent, metastable phase, δ ($Al_3Li$) which offers considerable strengthening. Nevertheless, development and widespread application of the Al-Li alloy system have been impeded mainly due to its inherent brittleness. It has been shown that the poor toughness of alloys in the Al-Li system is due to brittle fracture along the grain or subgrain boundaries. The two dominant microstructural features responsible for their brittleness appear to be the precipitation of intermetallic phases along the grain and/or subgrain boundaries and the marked planar slip in the alloys, which create stress concentrations at the grain boundaries. The intergranular precipitates tend to embrittle the boundary, and simultaneously extract Li from the boundary region to form precipitate free zones which act as sites of strain localization. The planar slip is largely due to the shearable nature of δ' precipitates which result in decreased resistance to dislocation slip on planes containing the sheared δ' precipitates.

Several metallurgical approaches have been undertaken to circumvent these problems. It has been found that the PFZ (precipitate free zone) and precipitate induced intergranular fracture can be reduced by controlling processing to avoid the intergranular precipitation of stable Al-Li, Al-Cu-Li, Al-Mg-Li phases. The problem of planar slip can be partly alleviated by promoting slip dispersion through the addition of dispersoid forming elements and the controlled co-precipitation of Al-Cu-Li, Al-Cu-Mg and/or Al-Li-Mg intermetallics. The dispersoid forming elements include Mn, Fe, Co, etc. The co-precipitation of Cu and/or Mg containing intermetallics appears to be relatively effective in dispersing the dislocation movement. However, the sluggish formation of these intermetallics requires the thermomechanical treatments involving (P. J. Gregson and M. M. Flower, Acta Metallurgica, vol. 33, pp. 527–537, 1985), or a high Cu content which adversely affects the density of alloys (B. van der Brandt, P. J. von den Brink, H. F. de Jong, L. Katgerman, and H. Kleinjan, in "Aluminum-Lithium Alloy II", Metallurgical Society of AIME, pp. 433–446, 1984). Moreover, the properties of alloys thus processed were less than satisfactory.

Recently, a new approach has been suggested to modify the deformation behavior of Al-Li alloy system through the development of Zr modified δ' precipitate. This approach is based on the observation that the metastable $Al_3Zr$ phase in the Al-Zr alloy system is highly resistant to dislocation shear and is of the same crystal structure ($Ll_2$) as δ'. In this regard, attempts have been made to produce a ternary ordered composite $Al_3$(Li, Zr) phase in the aluminum matrix with an alloy of Al-2.34 Li-1.07Zr (F. W. Gayle and J. B. van der Sande, Scripta Metallurgica, vol. 18, pp. 473–478, 1984). However, the process for developing a homogeneous distribution of such phase has required the strict control of processing parameters during the thermomechanical processing, as well as prolonged solutionizing and/or aging treatments. From the practical point of view, this process is quite undesirable and may also result in undesirable microstructural features such as recrystallization and wide precipitate free zones. Moreover, the process cannot be effectively applied to low Zr (e.g., 0.2 wt % Zr) containing alloys which produce a *small* volume fraction of *heterogeneously* distributed coarse composite precipitates (P. L. Makin and B. Ralph, Journal of Materials Science, vol. 19, pp. 3835–3843, 1984; P.J. Gregson and H. M. Flower, Journal of Materials Science Letters, vol. 3, pp. 829–834, 1984; P. L. Makin, D. J. Lloyd and W. M. Stobbs, Philosophical Magazine A, vol. 51, pp. L41–L47, 1985).

Alternatively, whilst the process can be applied to high Zr (e.g. 1.0 wt % Zr) containing alloys which produce a large volume fraction of shear resistant composite precipitates (F. W. Gayle et al., U.S. Pat. No. 4,747,884), the high Zr content also increases the density of the alloy. There remains a need in the art for an alloy and process wherein the characteristics of strength, toughness and ductility are combined with a lower density than has heretofore been achieved with extant zirconium content.

Despite considerable efforts to develop low density aluminum alloys, conventional techniques, such as those discussed above, have been unable to provide low density aluminum alloys having the sought for combination of high strength, high ductility and low density. As a result, conventional aluminum-lithium alloy systems have not been entirely satisfactory for applications such as aircraft structural components, wherein high strength, high ductility and low density are required.

SUMMARY OF THE INVENTION

The present invention provides a process for making rapidly solidified aluminum-lithium alloys containing a high density of substantially uniformly distributed shear resistant dispersoids which markedly improve the strength and ductility thereof. The low density rapidly solidified aluminum-base alloys of the invention consist essentially of the formula $Al_{bal}Zr_aLi_bX_c$, wherein X is at least one element selected from the group consisting of Cu, Mg, Si, Sc, Ti, U, Hf, Cr, V, Mn, Fe, Co and Ni, "a" ranges from about 0.2–0.6 wt %, "b" ranges from about 2.5–5 wt %, "c" ranges from about 0–5 wt % and the balance is aluminum. The microstructure of these alloys is characterized by the precipitation of composite $Al_3$-(Li, Zr) phase in the aluminum matrix thereof. This microstructure is developed in accordance with the process of the present invention by subjecting a rapidly solidified alloy having the formula delineated above to solutionizing treatment followed by multiple aging treatments. An improved process for making high strength, high ductility, low density aluminum-based alloy is thereby provides wherein the aluminum-based alloy produced has an improved combination of strength and ductility (at the same density).

The high strength, high ductility, low density rapidly solidified aluminum-based alloy produced in accordance with the present invention has a controlled composite $Al_3$(Li, Zr) precipitate which, advantageously, offers a wide range of strength and ductility combinations.

BRIEF DESCRIPTION OF THE DRAWINGS

The invention will be more fully understood and further advantages will become apparent when reference is made to the following detailed description and the accompanying drawings, in which:

FIG. 1 is a dark field transmission electron micrograph of an alloy having the composition Al-3.1Li-2Cu-1Mg-0.5Zr, the alloy having been subjected to double aging treatments (170° C. for 4 hrs. followed by 190° C. for 16 hrs.) to develop a composite precipitate in the aluminum matrix thereof;

FIG. 2 is a weak beam dark field micrograph of an alloy having the composition Al-3.7Li-0.5Zr, illustrating the resistance of the composite precipitate to dislocation shear during deformation;

FIG. 3(*a*) shows the planar slip observed in an alloy having the composition Al-3.7Li-0.5Zr, the alloy having been subjected to a conventional aging treatment (180° C. for 16 hours);

FIG. 3(*b*) shows the beneficial effect of subjecting the alloy of FIG. 3(*a*) to treatment in accordance with the claimed process (160° C. for 4 hrs. followed by 180° C. for 16 hrs.), thereby promoting the homogeneous deformation thereof;

FIG. 5 shows the development of composite precipitates in an alloy having the composition Al-3.2Li-3Cu-1.5Mg-0.2Zr, the alloy having been subjected to treatment in accordance with the claimed process (170° C. for 4 hrs. followed by 190° C. for 16 hrs.)

DESCRIPTION OF THE PREFERRED EMBODIMENTS

Figure 4:
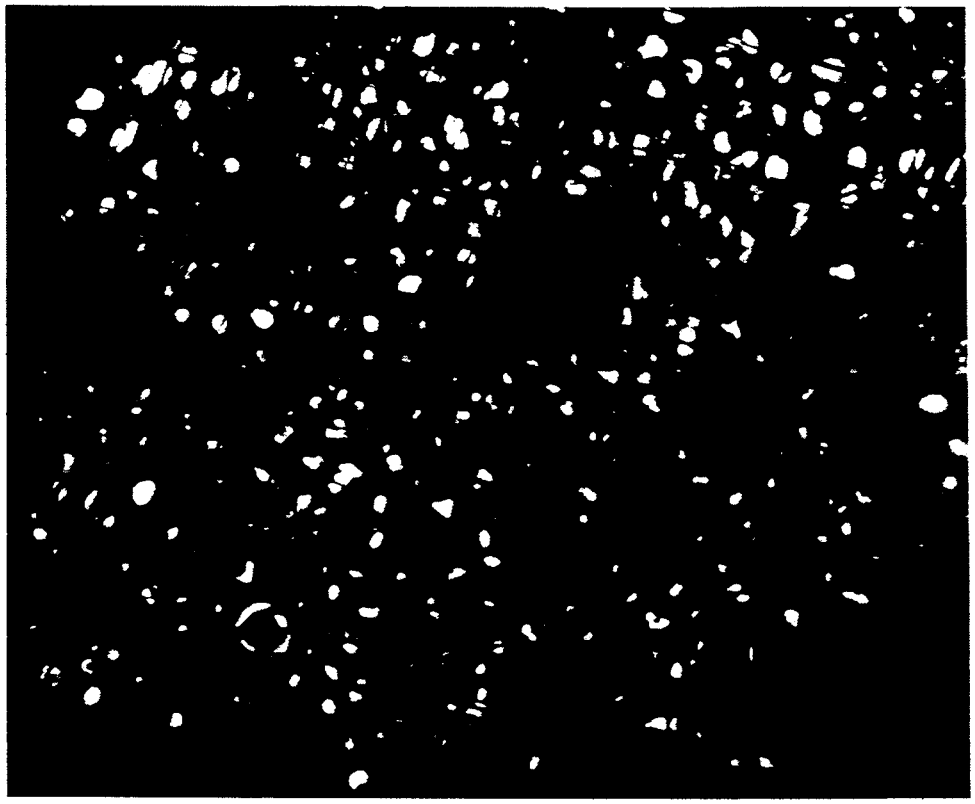
FIG. 4 shows the sheared δ' precipitates observed in an alloy having the composition Al-3.1Li-2Cu-1Mg-0.5Zr, the alloy having been subjected to a conventional aging treatment (190° C. for 16 hours)

In general, the present invention relates to the process of making high strength, high ductility, and low density rapidly solidified Al-Li-Zr-X alloys. Alloys of the invention are produced by rapidly quenching and solidifying a melt of a desired composition at a rate of at least about $10^{5°}$ $Cs^{-1}$ onto a moving, chilled casting surface. The casting surface may be, for example, the peripheral surface of a chill roll or the chill surface of an endless casting belt. Preferably, the casting surface moves at a speed of at least about 4000 $ft.min^{-1}$ (1220 $m.min^{-1}$) to provide a cast alloy strip approximately 30 to 75 mm in thickness, which has been uniformly quenched at the desired quench rate. Such strip can be 4" or more in width, depending upon the casting method and apparatus employed. Suitable casting techniques include, for example, jet casting and planar flow casting through a slot-type orifice. The strip is cast in an inert atmosphere, such as argon atmosphere, and means are employed to deflect or otherwise disrupt the high speed boundary layer moving along with the high speed casting surface. The disruption of the boundary layer ensures that the cast strip maintains contact with the casting surface and is cooled at the required quench rate. Suitable disruption means include vacuum devices around the casting surface and mechanical devices that impede the boundary layer motion. Other rapid solidification techniques, such as melt atomization and quenching processes, can also be employed to produce the alloys of the invention in non-strip form, provided the technique produces a uniform quench rate of at least about $10^{5°}$ $Cs^{-1}$.

Rapidly solidified alloys having the $Al_{bal}Zr_aLi_bX_c$ composition described above have been processed into ribbons and then formed into particles by conventional comminution devices such as pulverizers, knife mills, rotating hammer mills and the like. Preferably, the comminuted powder particles have a size ranging from about −40 to 200 mesh, US standard sieve size.

The particles are placed in a vacuum of less than $10^{-4}$torr ($1.33\times10^{-3}$ pa.) preferably less than $10^{-5}$ torr ($1.33\times10^{-3}$ Pa.), and then compacted by conventional powder metallurgy techniques. In addition, the particles are heated at a temperature ranging from about 300° C. to 550° C., preferably ranging from about 325° C. to 450° C., minimizing the growth or coarsening of the intermetallic phases therein. The heating of the powder particles preferably occurs during the compacting step. Suitable powder metallurgy techniques include direct powder extrusion by putting the powder in a can which has been evacuated and sealed under vacuum, vacuum hot compaction, blind die compaction in an extrusion or forging press, direct and indirect extrusion, conventional and impact forging, impact extrusion and combinations of the above.

The strengthening process involves the use of multiple aging steps during heat treatment of the alloy following rapid solidification thereof. The alloy is characterized by a unique microstructure consisting essentially of "composite" $Al_3$(Li, Zr) precipitate in an aluminum matrix (FIG. 1) due to the heat treatment as hereinafter described. The alloy may also contain other Li, Cu and/or Mg containing precipitates provided such precipitates do not significantly deteriorate the mechanical and physical properties of the alloy.

The factors governing the properties of the Al-Li-Zr-X alloys are primarily its Li content and micro-structure and secondarily the residual alloying elements. The microstructure is determined largely by the composition and the final thermomechanical treatments such as extrusion, forging and/or heat treatment parameters. Normally, an alloy in the as processed condition (cast, extruded or forged) has large intermetallic particles. Further processing is required to develop certain microstructural features for certain characteristic properties.

The alloy is given an initial solutionizing treatment, that is, heating at a temperature ($T_1$) for a period of time sufficient to substantially dissolve most of the intermetallic particles present during the forging or extrusion process, followed by cooling to ambient temperature at a sufficiently high rate to retain alloying elements in said solution. Generally, the time at temperature $T_1$, will be dependent on the composition of the alloy and the method of fabrication (e.g., ingot cast, powder metallurgy processed) and will typically range from about 0.1 to 10 hours. The alloy is then reheated to an aging temperature, $T_2$, for a period of time sufficient to activate the nucleation of composite $Al_3$(Li, Zr) precipitates, and cooled to ambient temperature, followed by a second aging treatment at temperature, for a period of time, $T_3$, for a period of time sufficient for the growth of the composite $Al_3$(Li, Zr) precipitate and a dissolution of δ' precipitate whose nucleation is not aided by Zr. The alloy at this point is characterized by a unique microstructure which consists essentially of composite $Al_3$(Li, Zr) precipitate. This composite $Al_3$(Li, Zr) precipitate is resistant to dislocation shear and quite effective in dispersing dislocation motion (FIG. 2). The result is that the alloy containing an optimum amount of composite $Al_3$(Li, Zr) precipitate deform by a homogeneous mode of deformation resulting in improved mechanical properties. FIG. 3(*b*) clearly shows the homogeneous mode of deformation in an alloy subjected to the process claimed in this invention, while FIG. 3(*a*) shows the severe planar slip observed in a conventionally processed alloy due to the shearing of δ' precipitates by dislocations (see FIG. 4). The combination of ductility with high strength is best achieved in accordance with the invention when the density of the shear resistant dispersoids ranges from about 10 to 60 percent by volume, and preferably from about 20–40 percent by volume.

The optimum and preferred amount of composite $Al_3$(Li,Zr) precipitate thus described is accomplished through the claimed chemistry and processing steps which maintain low density.

The exact temperature, $T_1$, to which the alloy is heated in the solutionizing step is not critical as long as there is a dissolution of intermetallic particles at this temperature. The exact temperature, $T_2$, in the first aging step where the nucleation of composite $Al_3$(Li, Zr) precipitate is promoted, depends upon the alloying elements present and upon the final aging step. The optimum temperature range for $T_2$, is from about 100° C. to 180° C. The exact temperature, $T_3$, whose range is from 120° C. to 200° C., depends on the alloying elements present and mechanical properties desired. Generally, the times at temperatures $T_2$ and $T_3$ are different depending upon the composition of the alloy and the thermomechanical processing history, and will typically range from about 0.1 to 100 hours.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLE 1

The ability of composite $Al_3$(Li, Zr) precipitates to modify the deformation behavior of rapidly solidified Al-Li-Zr alloys is illustrated as follows:

FIG. 2 is a weak beam dark field transmission electron micrograph showing microstructure of a deformed alloy (Al-3.7Li-0.5Zr) which has been rapidly solidified, solutionized at 540° C. for 4 hrs. and subsequently aged at 160° C. for 4 hrs. followed by final aging at 180° C. for 16 hrs. Such heat treatment promotes the precipitation of composite $Al_3$(Li, Zr) which is highly resistant to dislocation shear and is quite effective in dispersing the dislocation movement.

FIG. 3(*a*) shows a bright field electron micrograph showing microstructure of a deformed alloy (Al-3.7Li-0.5Zr) which has not been given the claimed process. The alloy following rapid solidification had been aged for 16 hrs. at 180° C. after solutionizing at 540° C. for 4 hrs. This alloy showed the pronounced planar slip which is the common deformation characteristic of brittle alloy.

In contrast, FIG. 3(*b*) illustrates the beneficial effect of the claimed process on the deformation behavior of an alloy having the composition Al-3.7Li-0.5Zr. After rapid solidification and then solutionizing at 540° C. for 4 hrs., the alloy had been subjected to the double aging treatment of 160° C. for 4 hrs. and 180° C. for 16 hrs. the deformation mode of this alloy is quite homogeneous indicating high ductility.

EXAMPLE 2

A rapidly solidified alloy having a composition of Al-3.1Li-2Cu-1Mg-0.5Zr was developed for medium strength applications as shown in Table I. The alloy was rapidly solidified and then solutionized at 540° C. for 2.5 hrs., quenched into water at about 20° C. and given conventional single aging and the claimed double aging treatments.

TABLE I

| | 0.2% Yield Strength (MPa) | Ultimate Tensile Strength (MPa) | Elongation to Failure (%) |
|---|---|---|---|
| Aged at 190° C. for 16 hrs. | 524 | 592 | 3.6 |
| Aged at 170° C. for 4 hrs. and 190° C. for 16 hrs. | 530 | 606 | 6.1 |

Conventional aging treatment (190° C. for 16 hrs.) showed poor ductility (3.6%) due to the shearing of δ' precipitate (FIG. 4), while composite precipitate developed by double aging (FIG. 1) improve both strength and ductility (6.1% elongation).

EXAMPLE 3

A high strength Al-Li alloy was made to satisfy the requirements for high strength applications for aerospace structure. A rapidly solidified alloy having a composition of Al-3.2Li-2Cu-2Mg-0.5Zr was rapidly solidified then solutionized at 542° C. for 4 hrs. As shown in Table II, conventional aging treatment (190° C. for 16 hrs.) showed lower strength (yield strength of MPa) and ductility (3.6%). However, double aging of the alloy (160° C. for 4 hrs. followed by 180° C. for 16 hrs.) gave significantly higher strength (yield strength of 554 MPa) and ductility (5.5%), which meets property requirements for high strength alloys needed for aerospace structural applications.

TABLE II

| | 0.2% Yield Strength (MPa) | Ultimate Tensile Strength (MPa) | Elongation to Failure (%) |
|---|---|---|---|
| Aged at 190° C. for 16 hrs. | 521 | 595 | 3.6 |
| Aged at 170° C. for 4 hrs. and 190° C. for 16 hrs. | 554 | 631 | 5.5 |

EXAMPLE 4

This example illustrates the beneficial effect of the claimed process on the mechanical properties of a simple ternary alloy Al-3.7Li-0.5Zr. The rapidly solidified alloy was rapidly solidified, solutionized at 540° C. for 4 hrs., and subsequently aged as shown in Table III. The resulting tensile properties show that the claimed process results in improved strength and ductility compared to the conventional process.

TABLE III

| Aging Treatment | 0.2% Yield Strength (MPa) | Ultimate Tensile Strength (MPa) | Elongation Failure (%) |
|---|---|---|---|
| 140° C., 16 hr. | 424 | 442 | 4.2 |
| 120° C., 4 hr. + 140° C., 16 hr. | 434 | 460 | 6.0 |
| 160° C., 16 hr. | 419 | 431 | 3.2 |
| 140° C., 4 hr. + 160° C., 16 hr. | 425 | 448 | 4.8 |
| 140° C., 16 hr. + 160° C., 16 hr. | 426 | 451 | 4.6 |

EXAMPLE 5

A wide range of mechanical properties can be achieved by subjecting a rapidly solidified alloy to multiple aging conditions. For example, a triple aging treatment (120° C., 4 hrs. +140° C., 16 hrs. +160° C., 4 hrs.) produced yield strength of 446 MPa and ultimate tensile strength of 464 MPa with 4.6% elongation. As a result, a variety of heat treatments of the rapidly solidified alloys according to the claims can be employed to produce alloys having a variety of mechanical properties.

EXAMPLE 6

This example illustrates the potential of the claimed process for the development of composite precipitate in low Zr containing rapidly solidified Al-Li alloys. FIG. 5 shows the dark field electron micrograph of a typical rapidly solidified alloy Al-3.2Li-3Cu-1.5Mg-0.2Zr which had been rapidly solidified, solutionized at 540° C. for 4 hrs., reheated to 170° C. for 4 hrs. followed by final aging at 190° C. for 16 hrs. The large volume fraction of composite $Al_3(Li, Zr)$ precipitate observed in such an alloy indicates that the claimed process is also quite effective in Al-Li alloys having low Zr content of 0.2%

EXAMPLE 7

This example illustrates the potential of the claimed process for the development of composite precipitates in a rapidly solidified alloy as specified in Example 4. The specific strength of the alloy (UTS) can be compared with the conventional ageing process conducted on an alloy outside the scope of the invention with high Zr content. It is evident from the specific strength that alloys having Zr content within 0.2 to 06 wt % range of the present invention produce an improved combination of high strength at low density.

TABLE IV

| Alloy | Aging Treatment | UTS (MPa) | Density p (gm/cm$^3$) | Specific Strength (UTS/p) |
|---|---|---|---|---|
| Al-3.7 wt % Li-0.5 wt % Zr | 140° C./ 16 hrs | 442 | 2.32 | 190.5 |
| Al-3.7 wt % Li-0.5 wt % Zr | 120° C./ 4 hrs + 140° C./ 16 hrs | 460 | 2.32 | 198.3 |
| Al-2.34 wt % Li-1.07 wt % Zr | 190° C./ 2 hrs | 479 | 2.45 | 195.5 |

Having thus described the invention in rather full detail, it will be understood that such detail need not be strictly adhered to but that further changes and modifications may suggest themselves to one skilled in the art, all falling within the scope of the present invention as defined by the subjoined claims.

We claim:

1. A process for increasing the strength and ductility of low density aluminum-base alloys comprising the steps of subjecting a rapidly solidified Al-Li alloy, to multiple aging treatments to form therein a microstructure wherein a high density of shear resistant dispersoids in the form of composite $Al_3(Li, Zr)$ precipitate and are substantially uniformly distributed, said alloy consisting essentially of the formula $Al_{bal}Zr_aLi_bX_c$, wherein X is at least one element selected from the group consisting of Cu, Mg, Si, Sc, Ti, U, Hf, Be, Cr, V, Mn, Fe, Co and Ni, "a" ranges from about 0.2–0.6 wt %, "b" ranges from about 2.5–5 wt %, "c" ranges from 0 to about 5 wt % and the balance is aluminum.

2. A process according to claim 1, wherein said rapidly solidified alloy is characterized by the precipitation of composite $Al_3(Li, Zr)$ phase in an aluminum matrix.

3. A process according to claim 1, wherein the number of aging treatments ranges from 2 to 10.

4. A process according to claim 1, wherein the number of aging treatments ranges from 2 to 5.

5. A process for making high strength, high ductility, low density rapidly solidified aluminum-lithium alloy, comprising the steps of:

heating a rapidly solidified aluminum alloy, consisting essentially of the formula $Al_{bal}Zr_aLi_bX_c$, wherein X is at least one element selected from the group consisting of Cu, Mg, V, Si, Sc, Ti, U, Hf, Be, Cr, Mn, Fe, Co and Ni, "a" ranges from about 0.2–0.6 wt %, "b" ranges from about 2.5–5 wt %, "c" ranges from 0 to about 5 wt % and balance of aluminum, to a temperature, T1, for a period of time sufficient to substantially dissolve most of the intermetallic particles therein;

cooling said alloy to ambient temperature at rates sufficient to retain its elements in supersaturated solid solution;

heating said alloy to a temperature, $T_2$, for a period of time sufficient to activate nucleation of composite $Al_3(Li, Zr)$ precipitates;

cooling said alloy to ambient temperature;

heating said alloy to a temperature, $T_3$, for a period of time sufficient to effect additional growth of composite $Al_3(Li, Zr)$ precipitates, and dissolution of $\delta'$ precipitates whose nucleation is not aided by Zr; and cooling said alloy to ambient temperature to produce therein a controlled precipitation of composite $Al_3(Li, Zr)$ phase in said aluminum matrix.

6. A process according to claim 5, wherein $T_1$ ranges from about 500° C. to 555° C., $T_2$ ranges from about 100° C. to 180° C. and $T_3$ ranges from about 120° C. to 200° C.

7. A process according to claim 5, wherein said alloy is rapidly solidified by forming a melt of said alloy and quenching said melt by directing it through a nozzle and into contact with a rapidly moving chill surface.

8. A process as recited by claim 9, wherein said alloy is quenched at a rate of at least about $10^{5°}$ $Cs^{-1}$.

9. A process as recited by claim 1, wherein said rapidly solidified alloy is formed by being quenched at a rate of at least about $10^{5°}$ $Cs^{-1}$.

* * * * *